United States Patent [19]

Kagechika

[11] Patent Number: 5,062,146

[45] Date of Patent: Oct. 29, 1991

[54] INFRARED RADIATOR

[75] Inventor: Hiroshi Kagechika, Tokyo, Japan

[73] Assignee: NKK Corporation, Tokyo, Japan

[21] Appl. No.: 420,959

[22] Filed: Oct. 13, 1989

[30] Foreign Application Priority Data

Nov. 8, 1988 [JP] Japan ..... 63-281832

[51] Int. Cl.[5] ..... H05B 3/16

[52] U.S. Cl. ..... 392/432; 219/553

[58] Field of Search ..... 219/345, 354, 543, 553, 219/216; 392/432, 433, 434, 435, 438, 439; 338/308, 309

[56] References Cited

U.S. PATENT DOCUMENTS

| | | | |
|---|---|---|---|
| 3,313,920 | 4/1967 | Gallez | 219/345 |
| 3,327,093 | 6/1967 | Hager, Jr. et al. | 219/345 |
| 3,453,413 | 7/1969 | Reynolds, Jr. | 219/345 |
| 3,607,389 | 9/1971 | Canegallo | 338/308 |
| 3,875,413 | 4/1975 | Bridgham | 219/354 |
| 3,934,119 | 1/1976 | Trenkler | 219/543 |
| 4,469,936 | 9/1984 | Hunter | 219/345 |
| 4,584,236 | 4/1986 | Colmon et al. | 219/543 |
| 4,644,141 | 2/1987 | Hagen et al. | 219/553 |
| 4,713,530 | 12/1987 | Schittenhelm et al. | 219/543 |
| 4,824,730 | 4/1989 | Fukuda et al. | 219/553 |
| 4,857,384 | 8/1989 | Mio et al. | 219/543 |
| 4,859,835 | 8/1989 | Balderson | 219/553 |
| 4,868,584 | 9/1989 | Nikaido et al. | 219/216 |
| 4,999,049 | 3/1991 | Balderson et al. | 219/553 |

FOREIGN PATENT DOCUMENTS

| | | | |
|---|---|---|---|
| 0177724 | 4/1986 | European Pat. Off. . | |
| 2442892 | 4/1975 | Fed. Rep. of Germany . | |
| 748650 | 5/1956 | United Kingdom | 219/345 |

OTHER PUBLICATIONS

New Materails Handbook, p. 69, published by the Trade and Industry Survey Association in Japan, Jan. 1986.

*Primary Examiner*—Geoffrey S. Evans

*Attorney, Agent, or Firm*—Frishauf, Holtz, Goodman & Woodward

[57] ABSTRACT

An infrared radiator which comprises: a substrate, at least one surface portion of which has an electric insulation property; a metal film, as a resistance heating element, formed on the at least one surface portion of the substrate; and infrared radiating particles, e.g. $ZRO_2$, $Al_2O_3$ and $SiO_2$, uniformly dispersed throughout the metal film.

19 Claims, 2 Drawing Sheets

INFRARED RADIATOR

As far as I know, there is available the following prior art document pertinent to the present invention:

"New Materials Handbook", page 69, published by the Trade and Industry Survey Association in Japan on Jan. 5, 1986.

The contents of the prior art disclosed in the above-mentioned prior art document will be discussed hereafter under the heading of the "BACKGROUND OF THE INVENTION."

FIELD OF THE INVENTION

The present invention relates to an infrared radiator used for infrared heating.

BACKGROUND OF THE INVENTION

Heat transfer mechanisms are broadly classified into heat conduction, heat convection and heat radiation. Infrared heating is based on heat radiation and does not need a thermal medium. Accordingly, an energy transfer efficiency achievable by infrared heating based on heat radiation is higher than that of the other heating based on heat conduction or heat convection. Infrared heating is therefore widely utilized in many areas including, machinery, metal, chemical, electrical, electronics, printing, food processing and medical. For example, infrared heating is used for bake-coating of a car body, curing of a thermoplastic resin, defreezing of a frozen food, heating of a room, and medical treatment of a human body.

The above-mentioned infrared heating is carried out by means of an infrared radiator for converting electric energy into heat radiation energy.

One of such infrared radiators is disclosed in the "New Materials Handbook", page 69, published by the Trade and Industry Survey Association in Japan on Jan. 5, 1986 (hereinafter referred to as the "prior art"). An infrared radiator 1 of the prior art is described below with reference to FIG. 1.

FIG. 1 is a schematic vertical sectional view illustrating the infrared radiator 1 of the prior art, as used as a room heating device. As shown in FIG. 1, the infrared radiator 1 of the prior art comprises a hollow casing 2 made of ceramics, and a nichrome wire (i.e., a nickel-chromium alloy wire) 3, as a resistance heating element, provided in the casing 2.

By causing electric current to flow through the nichrome wire 3 of the infrared radiator 1 of the prior art, the nichrome wire 3 generates heat, and as a result, the casing 2 made of ceramics emits the infrared rays.

However, the above-mentioned infrared radiator 1 of the prior art has the following defects:

(1) Difficulty in forming of ceramics restricts the size of the casing 2, thus making it impossible to manufacture a large-sized infrared radiator 1. It is therefore necessary, when heating a large room, to use a plurality of infrared radiators 1, requiring a higher cost.

(2) There is a gap between the casing 2 and the nichrome wire 3 as the resistance heating element, resulting in a large loss of heat transfer from the nichrome wire 3 to the casing 2, and hence in a low infrared radiation efficiency.

(3) The casing 2 made of ceramics is brittle and tends to easily break, thus requiring considerable care in handling.

(4) The nichrome wire 3 as the resistance heating element is easy to break, resulting in a short service life.

Another infrared radiator is proposed, which comprises a plate made of ceramics and a nichrome wire as a resistance heating element, stuck onto one surface of the plate. This infrared radiator, not having the defect (2) of the above-mentioned infrared radiator 1 of the prior art, has the other defects (1), (3) and (4), and in addition, the following defect:

Because of a considerable difference in thermal expansion coefficient between the plate made of ceramics and the nichrome wire as the resistance heating element, a serious thermal strain is produced during service, resulting in a peeloff occurring on the interface between the plate and the nichrome wire and an easy occurrence of cracks in the plate or breakage of the nichrome wire. This another infrared radiator cannot therefore withstand repeated use for a long period of time.

Under such circumstances, there is a strong demand for the development of an infrared radiator which is not subject to restrictions in size in the manufacture thereof, has a high infrared radiation efficiency, is hard to break, can withstand repeated use for a long period of time, and can be efficiently and economically manufactured, but such an infrared radiator has not as yet been proposed.

SUMMARY OF THE INVENTION

An object of the present invention is therefore to provide an infrared radiator which is not subject to restrictions in size in the manufacture thereof, has a high infrared radiation efficiency, is hard to break, can withstand repeated use for a long period of time, and can be efficiently and economically manufactured.

In accordance with one of the features of the present invention, there is provided an infrared radiator characterized by comprising:

a substrate, at least one surface portion of which has an electric insulation property;

a metal film, as a resistance heating element, formed on said at least one surface portion of said substrate; and infrared radiating particles uniformly dispersed throughout said metal film.

DETAILED DESCRIPTION OF PREFERRED EMBODIMENTS

From the above-mentioned point of view, extensive studies were carried out to develop an infrared radiator which is not subject to restrictions in size in the manufacture thereof, has a high infrared radiation efficiency, is hard to break, can withstand repeated use for a long period of time, and can be efficiently and economically manufactured.

As a result, the following finding was obtained: By forming a metal film, as a resistance heating element, on at least one surface portion having an electric insulation property of a substrate, and uniformly dispersing infrared radiating particles throughout the metal film, it is possible to obtain an infrared radiator which is not subject to restrictions in size in the manufacture thereof, has a high infrared radiation efficiency, is hard to break, can withstand repeated use for a long period of time, and can be efficiently and economically manufactured.

The present invention was developed on the basis of the above-mentioned finding. A first embodiment of the infrared radiator of the present invention is described below with reference to the drawings.

Figure 2:
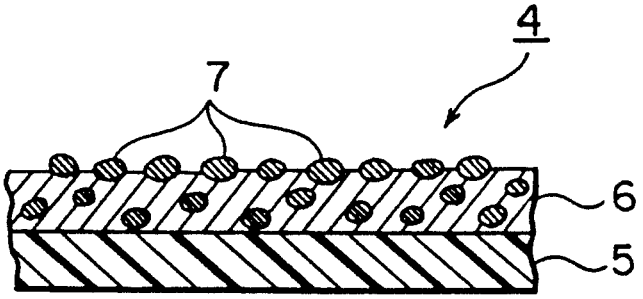
PRIOR ART FIG. 2
FIG. 2 is a schematic vertical partial sectional view illustrating a first embodiment of the infrared radiator of the present invention.

FIG. 2 is a schematic vertical partial sectional view illustrating a first embodiment of the infrared radiator of the present invention.

As shown in FIG. 2, the infrared radiator 4 of the first embodiment of the present invention comprises a substrate 5, a metal film 6 as a resistance heating element, formed on one surface of the substrate 5, and infrared radiating particles 7 uniformly dispersed throughout the metal film 6.

The substrate 5 comprises a heat-resistant, electrically insulating and heat-insulating plastic having a desired strength. Applicable plastics include a polyimide resin, a polyamide-imide resin, and an aromatic amide resin. The size of the substrate 5 is determined in accordance with the size of the infrared radiator 4, and the thickness of the substrate 5 is determined in accordance with the strength that the infrared radiator 4 is required to have.

In addition, the substrate 5 may comprise a heat-resistant, electrically insulating and heat-insulating glass having a desired strength.

The metal film 6 is formed, as the resistance heating element, on one surface of the substrate 5. The metal film 6 comprises a nickel alloy having a specific electric resistance of about 100 $\mu\Omega$cm, such as a nickel-chromium alloy or a nickel-phosphorus alloy.

The infrared radiating particles 7 are uniformly dispersed throughout the above-mentioned metal film 6. The infrared radiating particles 7 comprise ceramics such as zirconia ($ZrO_2$), alumina ($Al_2O_3$), silica ($SiO_2$) or a mixture thereof.

The average particle size of the infrared radiating particles 7 exerts an important effect on the quality of the infrared radiator 4. With an average particle size of the infrared radiating particles 7 of under 0.01 $\mu$m, there is a decrease in the precipitation efficiency of the infrared radiating particles 7 into the metal film 6 when applying the second method as described later. With an average particle size of the infrared radiating particles 7 of over 3 $\mu$m, on the other hand, the infrared radiating particles 7 are not dispersed uniformly throughout the metal film 6, and a heating efficiency of the infrared radiator 4 decreases. The average particle size of the infrared radiating particles 7 should therefore be limited within the range of from 0.01 to 3 $\mu$m.

The infrared radiator 4 having the construction as described above is manufactured in accordance, for example, with a first method followed by a second method as described below.

More particularly, the first method, which imparts an electric conductivity to one surface of the substrate 5, comprises the steps of:

sticking a vinyl protective film onto the other surface of the substrate 5;

dip-plating the substrate 5, onto the other surface of which the vinyl protective film has thus been stuck, in a dip-plating solution containing nickel ion and added with hypophosphite and a pH buffer, for a prescribed period of time, to form a nickel-phosphorus alloy film having a prescribed thickness on the entire surfaces of the substrate 5; and removing the vinyl protective film stuck onto the other surface of the substrate 5, together with the nickel-phosphorus alloy film formed on the surface of the vinyl protective film, to leave the nickel-phosphorus alloy film only on the one surface of the substrate 5.

The second method, which forms the metal film 6 as the resistance heating element, in which the infrared radiating particles 7 are uniformly dispersed, on the one surface of the substrate 5, comprises the steps of;

electroplating the substrate 5, on the one surface of which the nickel-phosphorus alloy film has been formed by the first method, in an electroplating solution containing nickel sulfate, nickel chloride, boric acid and phosphorous acid and added with zirconia ($ZrO_2$) particles, to form a nickel-phosphorus alloy film as the metal film 6, in which the infrared radiating particles 7 are uniformly dispersed, on the surface of the nickel-phosphorus alloy film formed on the one surface of the substrate 5 by the first method.

In the infrared radiator 4 manufactured in accordance with the above-mentioned first and second methods, when electric current flows through the metal film 6, the metal film 6 as the resistance heating element generates heat, and as a result, the infrared radiating particles 7 uniformly dispersed therein emit the infrared rays.

Figure 3:
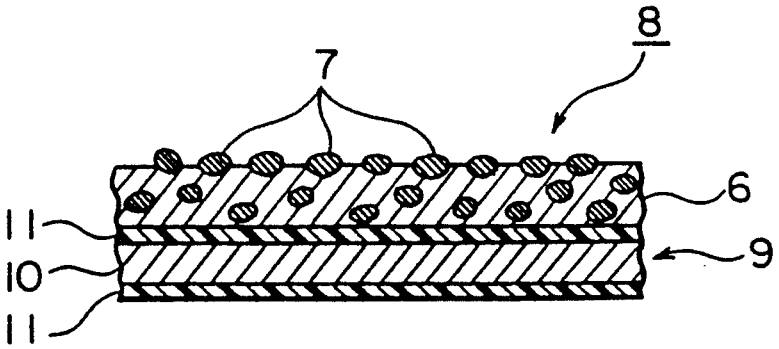
FIG. 3 is a schematic vertical partial sectional view illustrating a second embodiment of the infrared radiator of the present invention.

FIG. 3 is a schematic vertical partial sectional view illustrating a second embodiment of the infrared radiator of the present invention.

As shown in FIG. 3, the infrared radiator 8 of the second embodiment of the present invention is identical in construction to the above-mentioned infrared radiator 4 of the first embodiment of the present invention, except that a substrate 9 comprises a metal plate 10, and a heat-resistant plastic film 11 formed on the entire surfaces of the metal plate 10. Therefore, the same reference numerals are assigned to the same components as those in the first embodiment, and the description thereof is omitted. The substrate 9 comprises the metal plate 10 made of, for example, stainless steel, and the plastic film 11, of a polyimide resin, a polyamide-imide resin or an aromatic amide resin, formed on the entire surfaces of the metal plate 10. The above-mentioned metal plate 10 has the function of improving the strength of the substrate 9.

The film 11 of the substrate 9 may comprise a heat-resistant, electrically insulating and heat-insulating glass having a desired strength.

The film 11 of the substrate 9 may be formed not on the entire surfaces of the metal plate 10, but only on one surface thereof to electrically insulate the metal plate 10 from the metal film 6 as the resistance heating element.

The infrared radiator 8 of the second embodiment of the present invention is manufactured by the same manufacturing method as that of the above-mentioned infrared radiator 4 of the first embodiment of the present invention. The description of the manufacturing method thereof is therefore omitted.

In the infrared radiator 8 of the second embodiment of the present invention, when electric current flows through the metal film 6, the metal film 6 as the resistance heating element generates heat, and as a result, the infrared radiating particles 7 uniformly dispersed therein emit the infrared rays.

Figure 4:
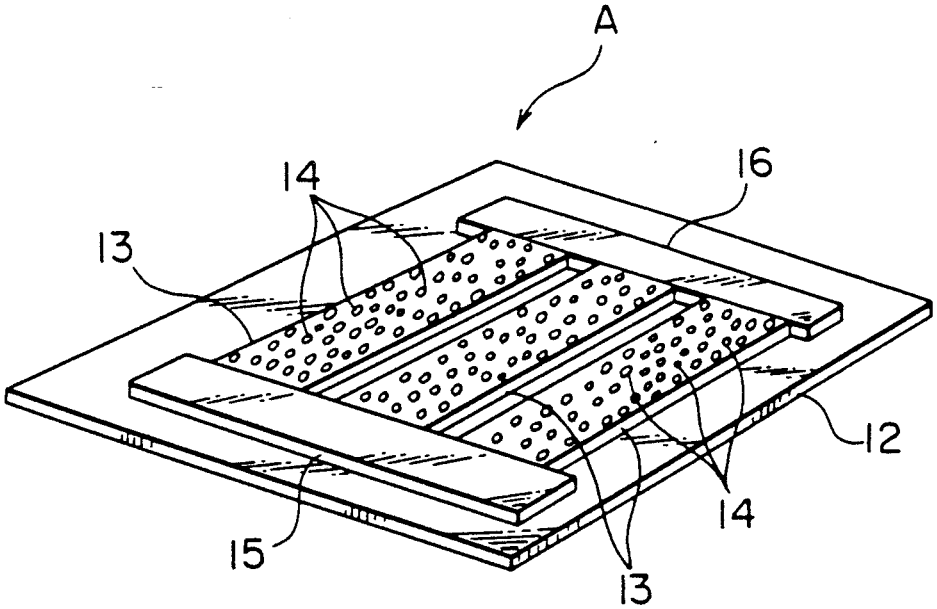
FIG. 4 is a schematic perspective view illustrating an example of the infrared radiator of the present invention.

Now, the infrared radiator of the present invention is described more in detail by means of an example with reference to FIG. 4.

EXAMPLE

An infrared radiator A of the present invention as shown in FIG. 4 was prepared by the following steps:

A plate made of a polyimide resin having a thickness of 100 μm was used as a substrate 12. For the purpose of imparting an electric conductivity to one surface of the substrate 12, a nickel-phosphorus alloy film was formed on the one surface portion of the substrate 12. More specifically, a vinyl protective film was stuck onto the other surface of the substrate 12, and then, the substrate 12, onto the other surface of which the vinyl protective film has thus been stuck was subjected to a dip-plating under the following conditions:

| | |
|---|---|
| (a) Chemical composition of dip-plating solution: | |
| Nickel chloride ($NiCl_2$): | 50 g/l, |
| Sodium hypophosphite ($NaPH_2O_2$): | 10 g/l, and |
| Sodium citrate ($Na_3C_6H_5O_7.2H_2O$): | 10 g/l, |
| (b) Bath temperature: | 90° C., |
| (c) pH value: | 5, |
| (d) Dip-plating time: | 1 minute, |

to form a nickel-phosphorus alloy film having a thickness of 0.1 μm on the entire surfaces of the substrate 12.

Then the vinyl protective film stuck onto the other surface of the substrate 12 was removed, together with the nickel-phosphorus alloy film formed on the surface of the vinyl protective film to leave the nickel-phosphorus alloy film only on the one surface of the substrate 12.

Then, an electrolating was applied to the substrate 12, on the one surface of which the nickel-phosphorus alloy film has been formed, under the following conditions:

| | |
|---|---|
| (a) Chemical composition of electroplating solution: | |
| Nickel sulfate ($NiSO_4$): | 250 g/l, |
| Nickel chloride ($NiCl_2$): | 60 g/l, |
| Boric acid ($H_3BO_3$): | 30 g/l, |
| Phosphorous acid ($H_2PHO_3$): | 45 g/l, |
| zirconia particles: | 150 g/l, |
| (average particle size: | 0.3 μm) |
| (b) Electric current density: | 3 A/dm$^2$, |
| (c) Bath temperature: | 50° C., |
| (d) pH value: | 4, |
| (e) electroplating time: | 10 minutes, |

to form a nickel-phosphorus alloy film 13 as the resistance heating element, having a thickness of 5 μm, in which the zirconia particles 14 were uniformly dispersed, on the surface of the nickel-phosphorus alloy film formed on the one surface of the substrate 12.

Then, an etching processing was applied to the substrate 12, on the one surface of which the nickel-phosphorus alloy film 13 has thus been formed, to divide the nickel-phosphorus alloy film 13 into a plurality of elongated parallel pieces as shown in FIG. 4.

More particularly, a resist solution was applied to portions of the surface of the nickel-phosphorus alloy film 13 on the one surface of the substrate 12, which portions correspond to the plurality of elongated parallel pieces to be formed, to cover these portions with the resist films. Then, portions of the nickel-phosphorus alloy film 13 not covered with the resist films were removed by means of an acidic etching solution to expose portions of the surface of the substrate 12, corresponding to the removed portions of the nickel-phosphorus alloy film 13. Then, the above-mentioned resist films were removed by means of a solvent, whereby the nickel-phosphorus alloy film 13 on the one surface of the substrate 12 was divided into a plurality of elongated parallel pieces, as the resistance heating element, as shown in FIG. 4.

Subsequently, electrodes 15 and 16 were formed at the both ends of the plurality of elongated parallel pieces as the nickel-phosphorus alloy film 13 on the one surface of the substrate 12.

More specifically, a resist solution was applied to the entire surfaces of the substrate 12 having on the one surface thereof the plurality of elongated parallel pieces as the nickel-phosphorus alloy film 13, except for portions of the one surface of the substrate 12 corresponding to the electrodes 15 and 16 to be formed, to cover these surfaces with the resist films. Then, the substrate 12, in which only the portions of the one surface corresponding to the electrodes 15 and 16 to be formed are not covered with the resist films, was subjected to a dip-plating under the following conditions:

| | |
|---|---|
| (a) Chemical composition of dip-plating solution: | |
| Copper sulfate ($Cu_2SO_4$): | 15 g/l, |
| Ethylenediaminetetraacetic acid: | 45 g/l, |
| ($(HOOCCH_2)_2NCH_2CH_2N(CH_2COOH)_2$) | |
| Formaldehyde (HCHO): | 15 g/l, |
| (b) Bath temperature: | 15 g/l, |
| (c) pH value: | 60° C., |
| (d) Dip-plating time: | 30 minutes, |

to form the electrodes 15 and 16 comprising copper and having a thickness of 5 μm on the portions of the one surface of the substrate 12 not covered with the resist films.

Then, the above-mentioned resist film was removed to prepare the infrared radiator A as shown in FIG. 4.

In the thus prepared infrared radiator A, the zirconia particles 14 had an exposed surface area ratio of about 70%. In the above-mentioned infrared radiator A, the metal film 13, in which the zirconia particles 14 were uniformly dispersed, had a specific electric resistance of 110 μΩcm.

Figure 1:
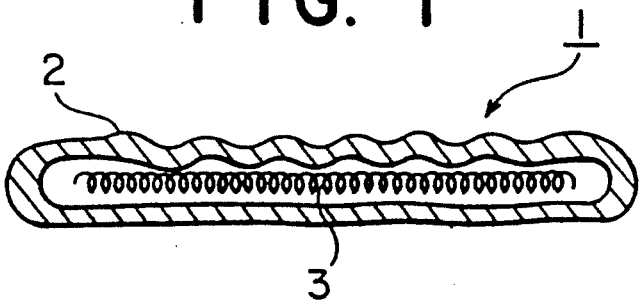
FIG. 1 is a schematic vertical sectional view illustrating an infrared radiator of the prior art, as used as a room heating device.

Electric current was caused to flow between the electrodes 15 and 16 of the above-mentioned infrared radiator A, to keep the surface temperature of the metal film 13, in which the zirconia particles 14 were uniformly dispersed, at 150° C., and the infrared radiation efficiency in this state was determined. The thus determined infrared radiation efficiency was over that determined for the infrared radiator of the prior art as shown in FIG. 1 under the same conditions.

Furthermore, in the case where the zirconia particles, as the ceramic particles uniformly dispersed in the metal film 13 of the above-mentioned infrared radiator A, were replaced by alumina particles or silica particles in the same amount as that for the zirconia particles, the same effect as in the above-mentioned infrared radiator A was available.

According to the present invention, as described above in detail, it is possible to obtain an infrared radiator which is not subject to restrictions in size in the manufacture thereof, has a high infrared radiation efficiency, is hard to break, can withstand repeated use for a long period of time, and can be efficiently and economically manufactured, thus providing many industrially useful effects.

What is claimed is:

1. An infrared radiator comprising:

a substrate, at least one surface portion of which has an electric insulation property;

a metal film, as a resistance heating element, formed on said at least one surface portion of said substrate; and infrared radiating particles uniformly dispersed throughout said metal film.

2. The infrared radiator as claimed in claim 1 wherein:

said substrate comprises a heat-resistant glass.

3. The infrared radiator as claimed in claim 1, wherein:

said metal film is divided into a plurality of elongated parallel pieces, one end of each of said plurality of elongated parallel pieces being connected to an electrode, and the other end of each of said plurality of elongated parallel pieces being connected to another electrode.

4. The infrared radiator as claimed in claim 1, wherein said substrate comprises a heat-resistant material selected from the group consisting of a polyimide resin, a polyamide-imide resin, an aromatic amide resin and a glass; said metal film comprising a nickel alloy selected from the group consisting of a nickel-chromium alloy and a nickel-phosphorus alloy; said infrared radiating particles being selected from the group consisting of zirconia, alumina, silica and mixtures thereof and having an average particle size of 0.01 to 3 μm.

5. The infrared radiator as claimed in claim 1, wherein the entire surfaces of the infrared radiating particles other than the portions thereof exposed on the surface of the metal film are in contact with the metal film.

6. The infrared radiator as claimed in claim 1, wherein:

said metal film comprises a nickel alloy.

7. The infrared radiator as claimed in claim 6 wherein:

said nickel alloy is selected from the group consisting of nickel-chromium alloy and nickel-phosphorus alloy.

8. The infrared radiator as claimed in claim 1, wherein:

said infrared radiating particles comprise ceramics.

9. The infrared radiator as claimed in claim 8, wherein:

said infrared radiating particles have an average particle size of 0.01 to 3 μm.

10. The infrared radiator as claimed in claim 8 or 9, wherein:

said infrared radiating particles are selected from the group consisting of zirconia ($ZrO_2$), alumina ($Al_2O_3$), silica ($SiO_2$) and mixtures thereof.

11. The infrared radiator as claimed in claim 1, wherein:

said substrate comprises a heat-resistant plastic.

12. The infrared radiator as claimed in claim 11, wherein:

said heat-resistant plastic is selected from the group consisting of a polyimide resin, a polyamide-imide resin, and an aromatic amide resin.

13. The infrared radiator as claimed in claim 11, wherein the plastic is a polyimide resin; the metal film comprises a nickel-phosphorus alloy; and the infrared radiating particles comprise zirconia particles.

14. The infrared radiator as claimed in claim 11, wherein the plastic is a polyimide resin; the metal film comprises a nickel-phosphorus alloy and the infrared radiating particles comprise alumina particles.

15. The infrared radiator as claimed in claim 1, wherein:

said substrate comprises a metal sheet and a heat-resistant plastic film formed on at least one surface of said metal sheet.

16. The infrared radiator as claimed in claim 1, wherein:

said substrate comprises a metal sheet and a heat-resistant glass film formed on at least one surface of said metal sheet.

17. The infrared radiator as claimed in claim 15 or 16, wherein:

said metal sheet comprises stainless steel.

18. The infrared radiator as claimed in claim 17, wherein said heat-resistant plastic is selected from the group consisting of a polyimide resin, a polyamide-imide resin and an aromatic amide resin.

19. The infrared radiator as claimed in claim 18, wherein said substrate comprises a heat-resistant material selected from the group consisting of a polyimide resin, a polyamide-imide resin, an aromatic amide resin and a glass; said metal film comprising a nickel alloy selected from the group consisting of a nickel-chromium alloy and a nickel-phosphorus alloy; said infrared radiating particles being selected from the group consisting of zirconia, alumina, silica and mixtures thereof and having an average particle size of 0.01 to 3 μm.

* * * * *